United States Patent [19]

Karlsson

[11] Patent Number: 5,024,362

[45] Date of Patent: Jun. 18, 1991

[54] TEAR-EDGE GUARD

[75] Inventor: Lars-Åke Karlsson, Skebokvarnsvägen, Sweden

[73] Assignee: Metsä-Serla OY, Mänttä, Finland

[21] Appl. No.: 472,740

[22] Filed: Jan. 31, 1990

[30] Foreign Application Priority Data

Feb. 7, 1989 [SE] Sweden ..... 8900418

[51] Int. Cl.[5] ..... B26F 3/02

[52] U.S. Cl. ..... 225/20; 225/19

[58] Field of Search ..... 225/19, 20, 21

[56] References Cited

U.S. PATENT DOCUMENTS

| | | | |
|---|---|---|---|
| 440,928 | 11/1890 | Schenk | 225/20 |
| 1,231,415 | 6/1917 | Nebergall | 225/20 |
| 2,125,736 | 8/1938 | Murray | 225/20 |
| 3,552,614 | 1/1971 | Wilson et al. | 225/20 |
| 3,972,458 | 8/1976 | Hamada | 225/20 |

FOREIGN PATENT DOCUMENTS 8900394 1/1989 PCT Int'l Appl. .

*Primary Examiner*—Douglas D. Watts
*Assistant Examiner*—John M. Husar
*Attorney, Agent, or Firm*—Toren, McGeady & Associates

[57] ABSTRACT

A guard intended to prevent hand-injuries against tear-bars has an elongated form (6) and extends parallel with a tear-edge and is moveable in a direction transversal to its longitudinal axis. The guard (6) has a length equal to the length of the tear-bar (2). The guard (6) is guided in a gap (5) defined between a strip-like (4) front side of the tear-bar (2) and an inwardly angled part of the wall (1) of the casing intended to accommodate, for instance, a paper-roll holder incorporating the tear-bar (2). For the purpose of limiting movement of the guard (6) between an outer active guard position and an inner inactive position, in which the tear-edge of the tear-bar (2) is exposed, there is provided along the guard (6) a rib (8) which abuts the free edge of the strip-like front side of the tear-bar in the outer position of the guard. The guard is displaced to its inner position in the gap (5) by the material web (P) when severing the paper-web against the tear-bar (2).

6 Claims, 1 Drawing Sheet

TEAR-EDGE GUARD

BACKGROUND OF THE INVENTION

1. Field of the Invention

The present invention relates to guard means for shielding elongated tear-edges, for instance the tear-edges provided on kitchen-paper roll holders.

2. Description of the Prior Art

The fact that the tear-edges provided on different types of roll-holders can cause injury to the hands of persons who grip carelessly the end of a paper roll contained in a roll-holder without due care to the presence of the tear-edges is very problematic. In order to enable kitchen paper to be produced at high machine-speeds and in order to provide a paper which is strong and durable in use, such paper will contain relatively strong fibres. Consequently, it is necessary for the tear-edge against which such paper is severed from the roll to be sharp and preferably also serrated. For obvious reasons, a sharp knife-edge is less practical or suitable in this connection, since the user cannot be relied upon to exercise care when reaching for the end of a paper roll, in order to sever a strip of paper therefrom.

Serrated tear-edges have long been used with the type of roll-holders meant here. Such tear-edges enable the paper to be severed at any point along its length and will also enable fibre-reinforced paper and other kinds of kitchen fabric to be severed from the roll along a straight line.

In order to minimize the risk of inflicting an injury when reaching for the end of a paper-roll hanging from a roll holder, it has been proposed that a relatively long length of paper should be left hanging from the holder. In the case of earlier designs of roll-holders with which the paper is taken from the roll through a centre cavity therein, the cylindrical tear-edge is located at a relatively long distance from the centre-hole in the bottom of the roll-holder through which the paper is pulled out. Despite the fact that this design enables the paper web to hang down through a distance equal to almost half the diameter of the roll-holder, it still does not eliminate completely the occurrence of hand injuries.

The next stage in the development of such holders resulted in the provision of a protective collar located externally of the tear-edge. However, in order for the collar to fulfill a protective function while not constituting an obstacle when severing a strip of paper from the roll, it was necessary to give the collar a wavy configuration, as evident for instance from SE-B-8202091-8.

Another method of reducing the risk of hand injuries from serrated tear-edges involves holding the tear-edges in a shielded location when not in use, and to advance the tear-edges to an active position when required for use. This method is the inventive subject of SE-B-8702872-6.

One drawback associated with tear-edges which need to be brought to an active position on given occasions is that they must be pivotally journalled and provided with means for transmitting movement of the roll when a length of paper is drawn therefrom.

In the case of roll-holders in which several such tear-edges are provided and mounted such as to enable one tear-edge to be swung out in dependence on the direction in which it is desired to sever paper from the roll, as with the invention according to the aforesaid published specification SE-B-8702872-6, it is necessary to provide one or more means for transferring movement of the paper web to respective pivotal tear-edges. This multi-part construction is prone to malfunction or is rendered awkward by the number of component parts involved. Furthermore, the construction requires the provision of springs operative to return the tear-edges to their respective shielded positions, subsequent to severing a length of paper from the roll.

SUMMARY OF THE INVENTION

The present invention pertains to the type of paper-roll holder of the kind with which a fixed tear-edge is located adjacent said holder, which holder may be constructed for withdrawing paper from the periphery of a paper roll or from the centre hole of a paper roll, and is intended to solve the problem of providing a tear-edge guard which remains active until the stage at which severing of the paper web takes place, whereupon the guard is moved to one side. The guard shall also be located externally of the tear-edge, such as to prevent unintentional contact with said edge. To this end, the inventive tear-edge guard has been given the characteristic features set forth in the following claims.

With the majority of roll-holders used today, the paper web is drawn from the holder substantially in a vertical direction, and consequently the requisite tear-edges are located on the bottom of the holder. These tear-edges are often positioned along three of the sides of the holder bottom, the fourth side being left plain because it is normally located adjacent the wall on which the holder is mounted. This holder is constructed to accommodate a roll with which the web is drawn from a centre hole in the roll. In the case of a paper-roll which is unwound from its periphery, the paper web leaves the holder in a flat state. Consequently, a single tear-edge will suffice to sever the web.

Since disposable kitchen fabric and reinforced kitchen paper requires the application of a relatively large force in order to sever a length of paper from the roll, it is necessary for the tear-edge to be stable, irrespective of whether it is serrated or not. Consequently, a rigidly fixed tear-edge is to be preferred, and for several reasons it is better that this edge is straight or possibly wave-shaped with undulations of relatively large radius. Immediately outside the tear-edge, which is provided on a tear-bar, as seen from the paper web, there is provided an elongated guard which covers the whole length of the tear-edge and which in its active protective position extends beyond the serrations of the tear-bar. By extending the casing of the roll-holder downwards and angling the casing in towards the tear-edge, there is formed a gap in which the elongated guard can move freely. In accordance with one advantageous embodiment of the invention, the tear-bar has a given width on the side thereof remote from the paper web and said side extends parallel with the downwardly drawn part of the casing of said holder, so as to afford enhanced stability. The tear-bar is also pointed, to provide an optimum tear function. As a result of the inclination of the gap obtained in this way, the elongated guard is guided gravitationally during its downward passage from the roll holder, such that only the outermost part of the guard will be located beneath the serrations of the tear-edge. When a downwardly pointing, horizontally extending tear-bar with associated elongated guard is considered from one end with a coordinate system included (FIG. 6) and the paper web is assumed to extend vertically through second II and third III quadrants parallel with the ordinate Y drawn through the tear-edge, a hand which is moved towards the guard within the whole of the fourth quadrant IV and the lower part of the first quadrant I will cause the elongated guard to be brought into abutment with the tear-edge (FIGS. 2-3). Consequently, when the guard is subjected to a force applied within an angle of 270-360, as related to the coordinate system in FIG. 6 the serrations of the tear-edge will be covered by the guard.

When a force is applied within an angle of less than 270° and all the way into the second quadrant II (<180°), the the guard will be moved to one side, away from the path of the paper web, and into the gap located between the front side of the tear-bar and the downwardly extended part of the casing. The web can now be severed against the tear-edge, whereafter the guard slides down out of the gap to its active protective position.

In those instances when the roll-holder is constructed to stand, for instance, on a floor with the paper-web outfeed aperture facing upwards, the tear-edge or edges must also face upwards. Accordingly, in order to maintain the guard in a position in which it covers the serrations of a tear-bar, the guard is provided with one or more springs located in said gap or in some other appropriate position which will maintain the guard in a position which covers the serrations of the tear bar. The force exerted by the springs is adapted so that when the paper web is moved against the guard, said guard is moved to one side and the paper web is brought into engagement with the serrations on the tear-bar.

With the majority of roll-holder constructions, i.e. roll-holders in which the paper web is pulled-out vertically downwards, the downward movement of the elongated guard can be restricted by providing an outwardly jutting rib along at least a part of the length of said guard and at an angle to the main part of said guard. The rib is positioned on the guard such that the lower edge of the ridge will reach the desired guard position beneath the tear-edge when the rib is brought into abutment with the strip-like upper edge on the front side of the tear-bar.

The elongated guard can be made more effective when a hook element is provided on the lower edge of said device, i.e. the edge which is located externally of the tear-edge in the active guard position of the guard.

This hook element may have the form two hooks, one close to each end of the tear-edge, or in the form of an angle-bend in the guard, this angle-bend extending along the whole of the lower edge of said guard. As a result of this hook arrangement, any object which comes into contact with the tear-edge must definitely approach from the third quadrant, preferably within an angle greater than 200°. Furthermore, this roll-holder construction enables the holder to be placed loosely on a working table. In this case, the guard is displaced slightly into the gap located between the front side of the tear-edge and the downwardly drawn part of the casing, until the hooks grip around the tear-edge and shield the serrations thereof.

The same stop effect is obtained with respect to the translatory movement of the elongated guard in the gap, and in its transverse direction, by providing rib-like projections on the inner wall of the casing, at an angle thereto. The lower ends of these projections are champhered or beveled at an angle greater than 90° to the gap, and hence the elongated guard will be caused to slide beyond the lower ends of the projections when subjected to a force that is applied within the third quadrant, thereby exposing the tear-edge.

The application of this force is achieved when a paper web is moved out from its vertically hanging position, and brought to a severing position against the tear-bar.

BRIEF DESCRIPTION OF THE DRAWING

A preferred embodiment of the invention will now be described in more detail with reference to the accompanying drawing, in which.

DETAILED DESCRIPTION OF THE PREFERRED EMBODIMENTS

Figure 1:
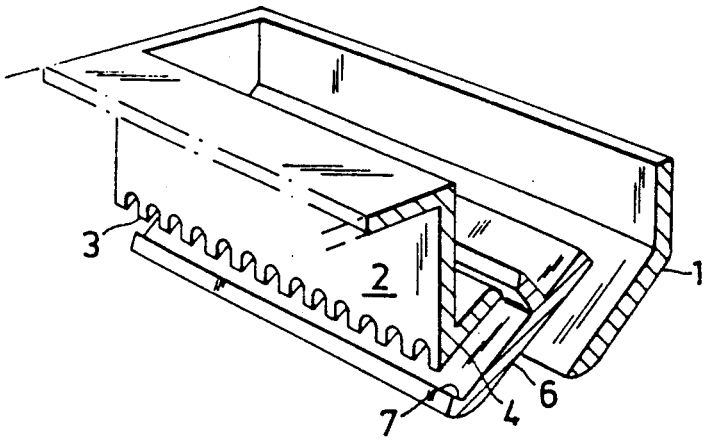
FIG. 1 is a perspective, cross-sectional view of a tear-bar provided with a guard in a gap defined between the front side of the tear-bar and a part of the casing of a roll-holder.
Figure 2:
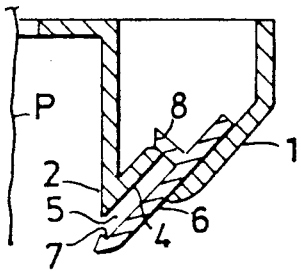
FIG. 2 is a cross-sectional view through the aforesaid three parts, with the guard being shown in its active protective position.

A holder intended for accommodating a roll of, for instance kitchen paper and being of the kind with which the paper is withdrawn from the centre of the roll includes a casing having a wall 1 which is angled inwardly at the bottom thereof, towards the centre of the roll-holder. Located inwardly of the wall 1 is a tear-bar 2 provided with serrations 3 and inclined at an acute angle for the purpose of facilitating severing of the paper web. The front side of the tear-bar 2, which forms one leg of an angle and which departs from the serrations 3, includes a strip-like part 4. Between the strip-like part 4 and the inner surface of the inwardly angled lower part of the wall 1, there is formed a gap 5 in which an elongated guard 6 extending parallel with the tear-bar 2 is able to move freely in its cross-direction, i.e. to slide up and down.

For the purpose of providing an active guard against the tear-bar 2, the edge of the guard 6 which projects furthest from the gap 5 is located externally of the serrations 3 of the tear-bar 2. As an additional precaution against unintentional contact with the tear-bar 2, the guard 6 is provided with hook means 7 which are integral with the aforesaid outer edge of the guard 6. When a hand is moved towards the guard 6 from outside the holder, or immediately from beneath, the guard 6 will be displaced into the gap 5 to some small extent, such that the hook means 7 engage around the tear-bar 2.

When the length P of paper hanging from the interior of the holder is to be severed, the paper length is moved towards the tear-bar 2 and therewith brought into contact with the guard 6, which is consequently moved up in the gap 5 successively with the tension forces engendered in the paper length P. Subsequent to severing the paper length P from the roll of paper in the holder, wherewith the force acting on the guard is relieved, the guard 6 will slide down gravitationally through the gap 5 until a rib 8, which projects at an angle to the plane of the guard 6, comes into abutment with the upper, free edge of the strip-like part 4. The lower edge of the guard 6 will then project beyond the tear-bar 2.

Figure 5:
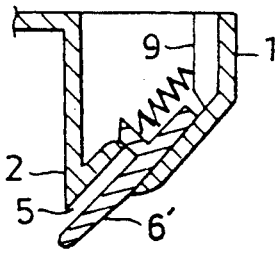
FIGS. 5-7 are cross-sectional views of an alternative embodiment of the guard in positions corresponding to the positions illustrated in FIGS. 2-4.
Figure 3:
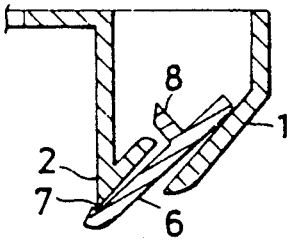
FIG. 3 is a cross-sectional view of the aforesaid three parts, with the hook-shaped lower edge of the guard being shown in engagement with the tear-bar.

In one variant of the invention (illustrated in FIGS. 5–7) the lower edge of the guard 6' is devoid of hook means 7. In the case of this embodiment, in order to ensure that the guard 6' will cover the tear-bar 2, for instance when a hand is moved towards the bar, translatory movement of the guard 6' in the gap 5 is prevented by two or more rib-like projections 9. These projections are preferably beveled at an obtuse angle to the gap 5, so that the guard 6' is able to slide past said ribs, when a tension force acting in the paper length P causes said paper length to press against the lower edge of the guard 6'.

I claim:

1. A tear-bar guard, which is elongated so as to extend along the entire length of a tear-edge of a tear-bar, and movable into an active protective position in which the guard extends externally beyond the tear-bar, said elongated tear-bar guard being abuttable with the tear-bar (2) when subjected to a force within an angle of 270°–360° relative to a coordinate system in which the tear-bar extends 180° from 90°–270° and faces an object to be severed, said guard being movable to one side when a force is applied within an angle 185°–270° so as to expose the tear-bar (2) to permit severing of the object.

2. A guard according to claim 1, wherein the tear-bar (2) is downwardly facing and is provided on a side thereof remote from the object (P) to be severed with a strip-like part (4) and a wall (1) which extends parallel to said strip-like part (4), said wall and said strip-like part together defining a gap (5) in which the elongated guard (6) is movable freely between said active position, in which said guard covers the tear-edge of the tear bar (2), and an inactive position in which the tear-edge is exposed.

3. A guard according to claim 1, wherein the tear-bar (2) is upwardly directed and has a reverse side with a strip configuration angled to said tear-bar, and a wall which extends parallel with the strip, said strip and said wall defining therebetween a gap in which the elongated guard is held in its active position by at least one spring.

4. A guard according to claim 2, wherein the elongated guard (6) is provided along a major part of its length with an outwardly projecting rib (8) which forms an angle with a transverse axis of said guard so that in the active position of said guard said rib abuts a free edge of the strip-like part (4).

5. A guard according to claim 1, wherein the edge which extends externally beyond the tear-edge in the active guard position of said guard is provided with at least one hook (7) which is engageable with the tear-bar when a force is applied to the guard (6) within an angle of 260°–360°.

6. A guard according to claim 2, wherein at least two projections are provided adjacent the wall at an angle thereto so that when a force is applied to the outer edge of the elongated guard (6) within an angle of 240°–330°, said projections are active to prevent translatory movement of the guard within the gap (5) before the outer edge of the guard (6) exposes the tear-edge.

* * * * *

UNITED STATES PATENT AND TRADEMARK OFFICE

CERTIFICATE OF CORRECTION

PATENT NO. : 5,024,362

DATED : June 18,1991

INVENTOR(S) : Lars-Ake Karlsson

It is certified that error appears in the above-identified patent and that said Letters Patent is hereby corrected as shown below:

The Title page should be deleted to appear as per attached title page.

The sheet of drawing should be deleted, to be replaced with attached sheet.

Signed and Sealed this

Twenty-second Day of December, 1992

*Attest:*

DOUGLAS B. COMER

*Attesting Officer*

*Acting Commissioner of Patents and Trademarks*

United States Patent [19]

Karlsson

[11] Patent Number: 5,024,362

[45] Date of Patent: Jun. 18, 1991

[54] TEAR-EDGE GUARD

[75] Inventor: Lars-Åke Karlsson, Skebokvarnsvägen, Sweden

[73] Assignee: Metsä-Serla OY, Mänttä, Finland

[21] Appl. No.: 472,740

[22] Filed: Jan. 31, 1990

[30] Foreign Application Priority Data

Feb. 7, 1989 [SE] Sweden ..... 8900418

[51] Int. Cl.[5] ..... B26F 3/02

[52] U.S. Cl. ..... 225/20; 225/19

[58] Field of Search ..... 225/19, 20, 21

[56] References Cited

U.S. PATENT DOCUMENTS

| | | | |
|---|---|---|---|
| 440,928 | 11/1890 | Schenk | 225/20 |
| 1,231,415 | 6/1917 | Nebergall | 225/20 |
| 2,125,736 | 8/1938 | Murray | 225/20 |
| 3,552,614 | 1/1971 | Wilson et al. | 225/20 |
| 3,972,458 | 8/1976 | Hamada | 225/20 |

FOREIGN PATENT DOCUMENTS 8900394 1/1989 PCT Int'l Appl. .

*Primary Examiner*—Douglas D. Watts
*Assistant Examiner*—John M. Husar
*Attorney, Agent, or Firm*—Toren, McGeady & Associates

[57] ABSTRACT

A guard intended to prevent hand-injuries against tear-bars has an elongated form (6) and extends parallel with a tear-edge and is moveable in a direction transversal to its longitudinal axis. The guard (6) has a length equal to the length of the tear-bar (2). The guard (6) is guided in a gap (5) defined between a strip-like (4) front side of the tear-bar (2) and an inwardly angled part of the wall (1) of the casing intended to accommodate, for instance, a paper-roll holder incorporating the tear-bar (2). For the purpose of limiting movement of the guard (6) between an outer active guard position and an inner inactive position, in which the tear-edge of the tear-bar (2) is exposed, there is provided along the guard (6) a rib (8) which abuts the free edge of the strip-like front side of the tear-bar in the outer position of the guard. The guard is displaced to its inner position in the gap (5) by the material web (P) when severing the paper-web against the tear-bar (2).

6 Claims, 1 Drawing Sheet

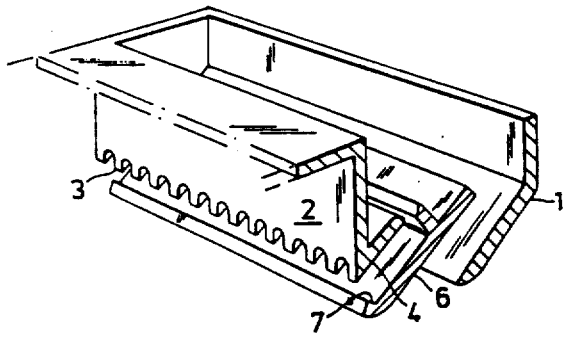

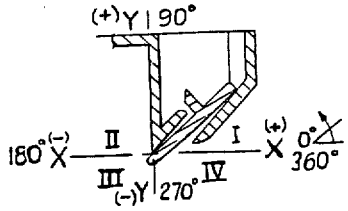

UNITED STATES PATENT AND TRADEMARK OFFICE

CERTIFICATE OF CORRECTION

PATENT NO. : 5,024,362

DATED : June 18, 1991

INVENTOR(S) : Lars-Åke Karlsson

Figure 6:
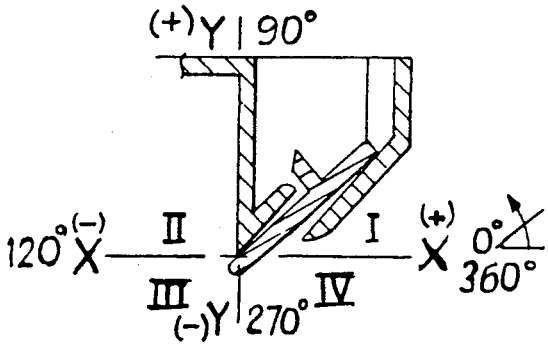
Figure 4:
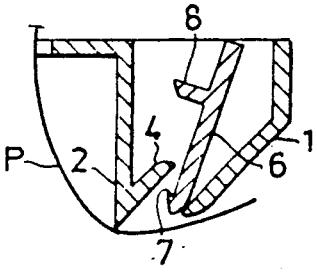
FIG. 4 is a cross-sectional view of said three parts, and shows the guard pushed-up in the gap.
Figure 7:
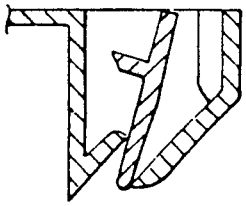
Figure 1:
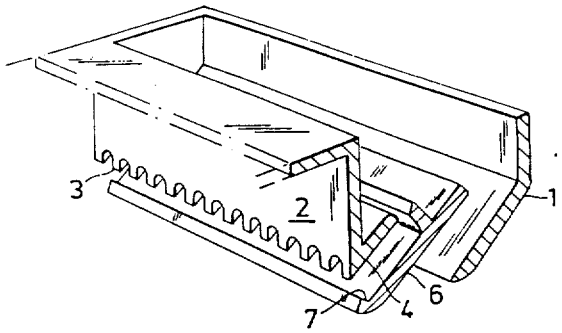
Figure 2:
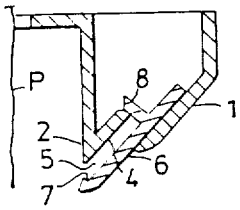
Figure 5:
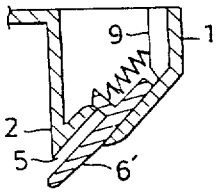
Figure 3:
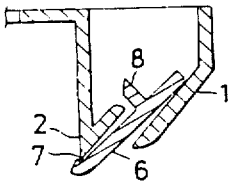
Figure 6:
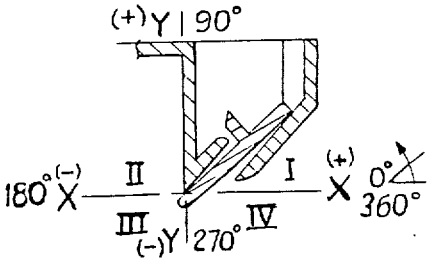
Figure 4:
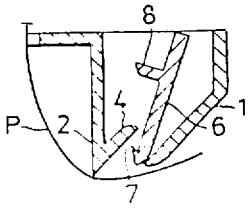
Figure 7:
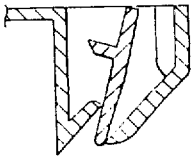

It is certified that error appears in the above-identified patent and that said Letters Patent is hereby corrected as shown below:

In Fig. 6, change "120°" to -- 180° --.

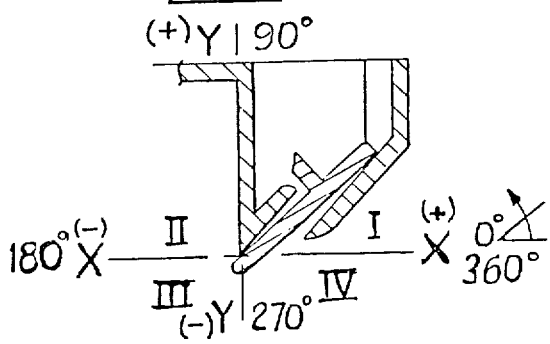

Fig. 6